United States Patent [19]

Whitehouse

[11] 4,422,267

[45] Dec. 27, 1983

[54] GEODESIC DOME-TYPE BUILDING STRUCTURE

[76] Inventor: Oliver D. Whitehouse, 9610 Frascatti Way, Santee, Calif. 92071

[21] Appl. No.: 292,609

[22] Filed: Aug. 13, 1981

[51] Int. Cl.[2] ..... E04B 1/32

[52] U.S. Cl. ..... 52/81

[58] Field of Search ..... 52/80, 81, 82, DIG. 10, 52/281, 282

[56] References Cited

U.S. PATENT DOCUMENTS

| | | | |
|---|---|---|---|
| 2,918,992 | 12/1959 | Gelsavage | 52/81 |
| 3,694,933 | 10/1972 | Busch | 52/36 |
| 3,810,336 | 5/1974 | Sadao | 52/81 |
| 3,857,212 | 12/1974 | Barnett | 52/81 |
| 3,925,940 | 12/1975 | O'Connell et al. | 52/81 |
| 4,263,758 | 4/1981 | Seaich | 52/DIG. 10 |

*Primary Examiner*—James L. Ridgill, Jr.

*Attorney, Agent, or Firm*—Brown & Martin

[57] ABSTRACT

A geodesic dome-type building structure includes a central top hexagon panel unit surrounded by alternate pentagon and trapezoid units defining a roof structure supported on vertically extending walls formed of vertical rectangular panels separated by pairs of quadrilateral panels. This structure forms a self supporting building with expenses of vertical rectangular walls for hanging of conventional doors and other similar building units as well as interfacing with conventional rectangular walled three dimensional building structures.

7 Claims, 6 Drawing Figures

GEODESIC DOME-TYPE BUILDING STRUCTURE

BACKGROUND OF THE INVENTION

The present invention relates to building structures and pertain particularly to a modified form of geodesic dome building structure.

The geodesic dome building structure has been known for many years. The geodesic dome building concept has many advantages in terms of economy of construction due to its high strength per pound of material as well as high space of enclosure per unit of material utilized.

Such domes, while of considerable interest today because of the increasing cost of materials and labor, have a number of drawbacks which prevent their ready acceptance by the building industry and by the general public. Among these drawbacks are the absence of flat vertical rectangular walls from which conventional doors, cabinets and other similar units can be hung.

Other drawbacks include the difficulty of interfacing a geodesic dome structure with conventional three dimensional rectangular and cubical room or building structures.

Many attempts to overcome these problems have been proposed in the past and have met with limited success.

It is therefore desirable that an improved geodesic dome-type building structure be available which provides for accommodating and interfacing with conventional units and structures.

SUMMARY AND OBJECTS OF THE INVENTION

It is therefore the primary object of the present invention to provide an improved geodesic dome type building structure.

In accordance with the primary aspect of the present invention, a geodesic type dome structure is constructed with a primary central hexagon roof panel surrounded by a plurality of pentagon and trapezoid units supported on vertical rectangular and quadrilateral wall units.

BRIEF DESCRIPTION OF THE DRAWINGS

The above and other objects and advantages of the present invention will become apparent from the following description when read in conjunction with the drawings, wherein.

DETAILED DESCRIPTION OF PREFERRED EMBODIMENTS

Figure 1:
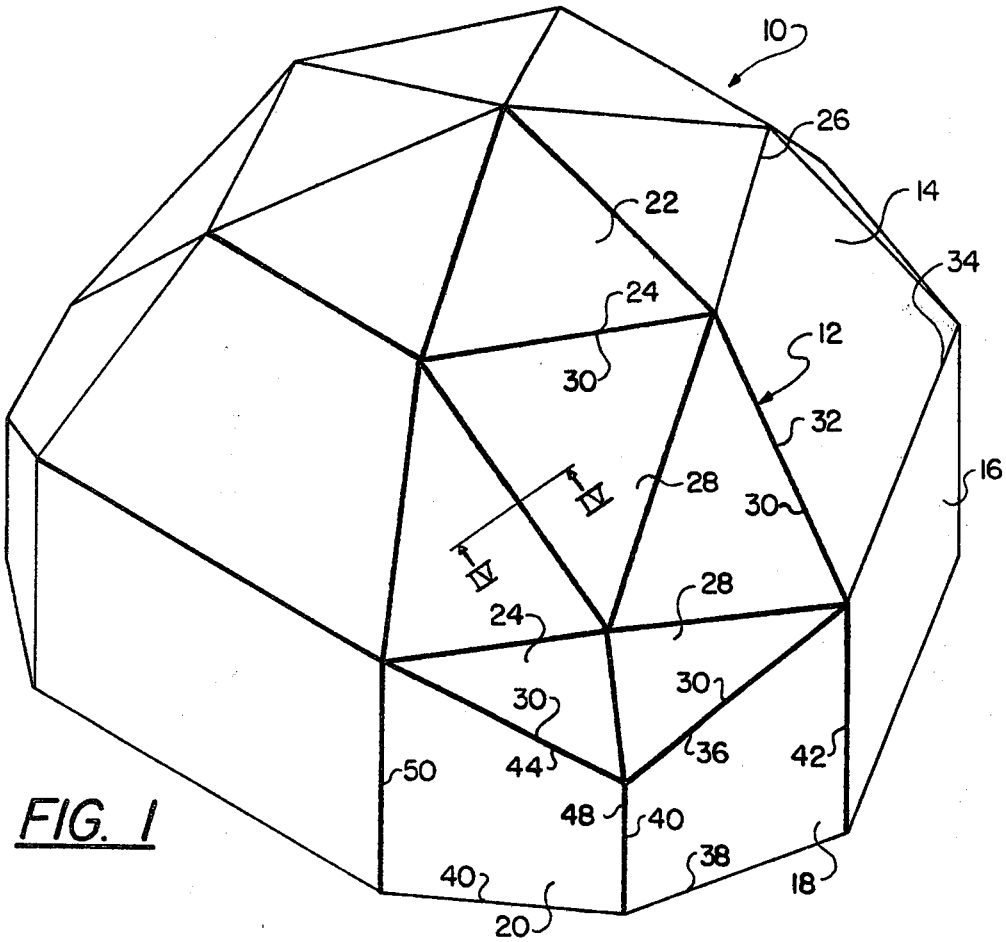
FIG. 1 is a perspective view of a building structure in accordance with the invention.

As best illustrated in FIG. 1, the building is a geodesic dome-type of structure with a self supporting shell constructed of multiple geometric panels that support the structure without the use of a skeleton framework. The shape of the building structure due to certain panel configurations is not truly hemispherical and is therefore not truly geodesic in configuration. The interrelationship of the panels define certain features which enhances the utility of the structure as will be explained.

The building is constructed of a plurality of the panels interconnected as shown including a central hexagonal roof panel or unit 10 surrounded by a plurality of units consisting of a pentagonal unit 12 alternately interspersed with a trapezoidal unit 14. Three of the pentagonal units 12 are alternated with three of the trapezoidal units 14 to form the lower roof structure which rests on a plurality of vertically extending wall panels. The wall panels comprise a plurality of rectangular panels 16 separated by pairs of quadrilateral panels 18 and 20.

The central hexagonal roof structure or unit 10 may be made up of a single unit or may be made of a plurality of separate triangular units. Preferably the structure is formed of a single unit of triangular shaped panels having their bases lying in a common plane with the apex of each triangular section displaced from the common plane and located at a common point forming a dished or concaval convex structure. This forms the central roof structure around which the plurality of alternately shaped geometric structures are. The hexagonal unit 10 is preferably made up of equalateral triangles with the bases and sides selected to form a desired slope of the central roof structure. The hexagonal roof panel 10 is made up of a plurality of triangular sections 22, each of which has a base 24 which must correspond precisely to length of the top edge 26 of the trapezoid 14. Similarly, the pentagon section of unit 12 is made up of a plurality of triangular sections 28, each of which includes a base 30 which corresponds in length to the base 24 of the triangle 22 and similarly the side edge 32 of the trapezoidal panel 14. This of course assumes that the triangles 28 of the pentagonal unit 12 are identical in size and angle. Although these panels are preferably of an identical size and angle, such is not absolutely essential.

The rectangular panel 16 has a width that corresponds to the width of the base 34 of the base of the trapezoid panel 14. The height of the rectangular panel 16 may be selected to give an appropriate overall height to the building.

The guadrilateral panel 18 includes an upper edge 36 that corresponds in length to the base 30 of the adjacent triangular panel 28 of the pentagonal section 12. The height of the panel 18 will be determined by the height selected for the rectangular panel 16 with the base 38 thereof controlled by the length of the edge 36 and the requirement of maintaining sides 40 and 42 parallel.

The quadrilateral panel 20 similarly includes an upper sloping edge 44 that corresponds in length to the adjacent edge 30 of the triangular panel 24 and similarly includes a base 46 with sides 48 and 50 corresponding to the abutting sides of adjacent panels 18 and 16.

As explained, in the preferred construction technique, each of the hexagon units and the pentagon units are made up of individual triangular panels. While this duplicates some structural members, the size of the triangular panels for each of the units dictate that they be constructed as individual units in order that they may be easily handled. For example, the triangular panel for the roof hexagon would have a base on the order of about 9 feet, 4 and ½ inches with each side having a length of about 9 feet 9 and ½ inches for a height of 8 feet, 7 and ½ inches. Thus the overall central hexagon roof unit is preferably constructed of multiple triangular panels rather than as a single unit.

Similarly the wall or roof triangular panels of the pentagon unit would have dimensions on the order of 9 feet, 4 and ½ inches as a base to match and correspond with the base of the roof units with a side of 8 feet, 7 and ½ inches for a height of 7 feet, 3 and ⅞ inches.

With panels of this dimension and corresponding related panels, a building would have a height on the order of about 20 feet, 4 inches from the top of the foundation and would have a width of 32 feet at the widest portion and about 30 feet, 6 inches at the narrowest section.

Figure 2:
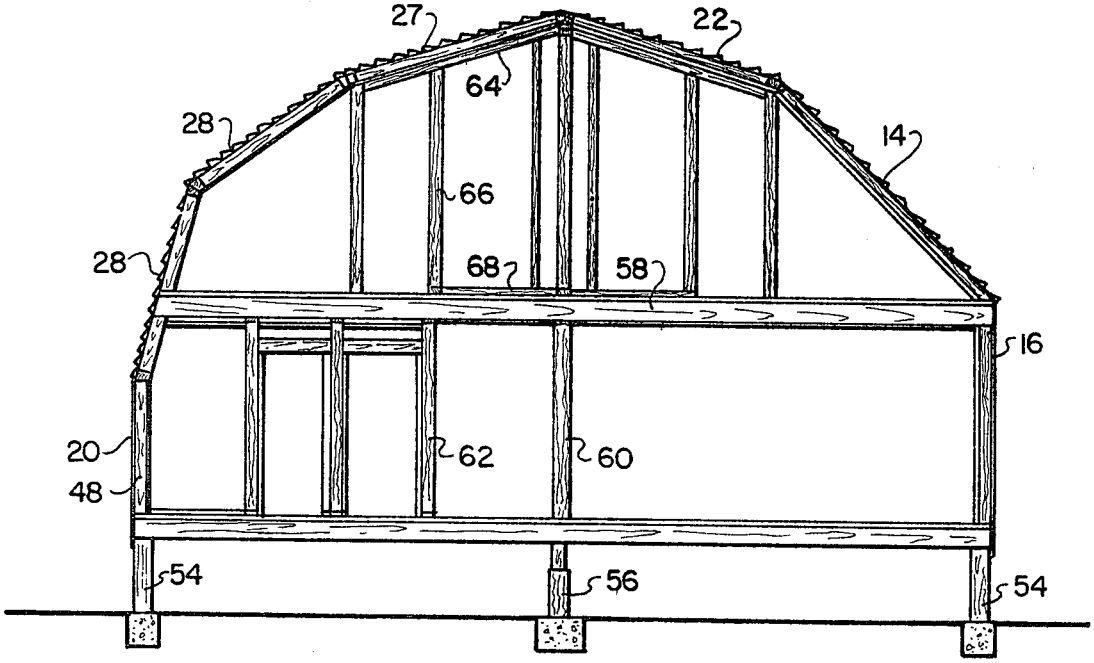
FIG. 2 is a section view of the building unit of FIG. 1.

Turning to FIG. 2, the structure as shown would have a height from the top of the foundation of about 20 feet, 4 inches and a width as shown of about 30 feet, 6 inches. This is sufficient to enable the construction of a loft or upstairs section as shown in FIG. 2.

As shown in FIG. 2, the interior of the shell can be arranged to provide a two story structure. The illustration in FIG. 2 shows the shell structure resting on a floor platform 52 which rests on foundation structures 54 and 56. Alternately the shell can rest on a concrete slab or the like. Suitable ceiling and floor joist 58 are secured in place at an appropriate height, separating the shell into upper and lower spaces. The ceiling and floor joist 58 may be secured in any well known structural fashion to the interior structure of the shell and additionally be supported by additional wall support structures including studs or the like 60 and 62. Additionally suitable wall framing including headers 64, studs 66 and plates 68 may be utilized for interior wall support in the upstairs space. Appropriate adjustments can be made in the spaced structure as desired.

Figure 3:
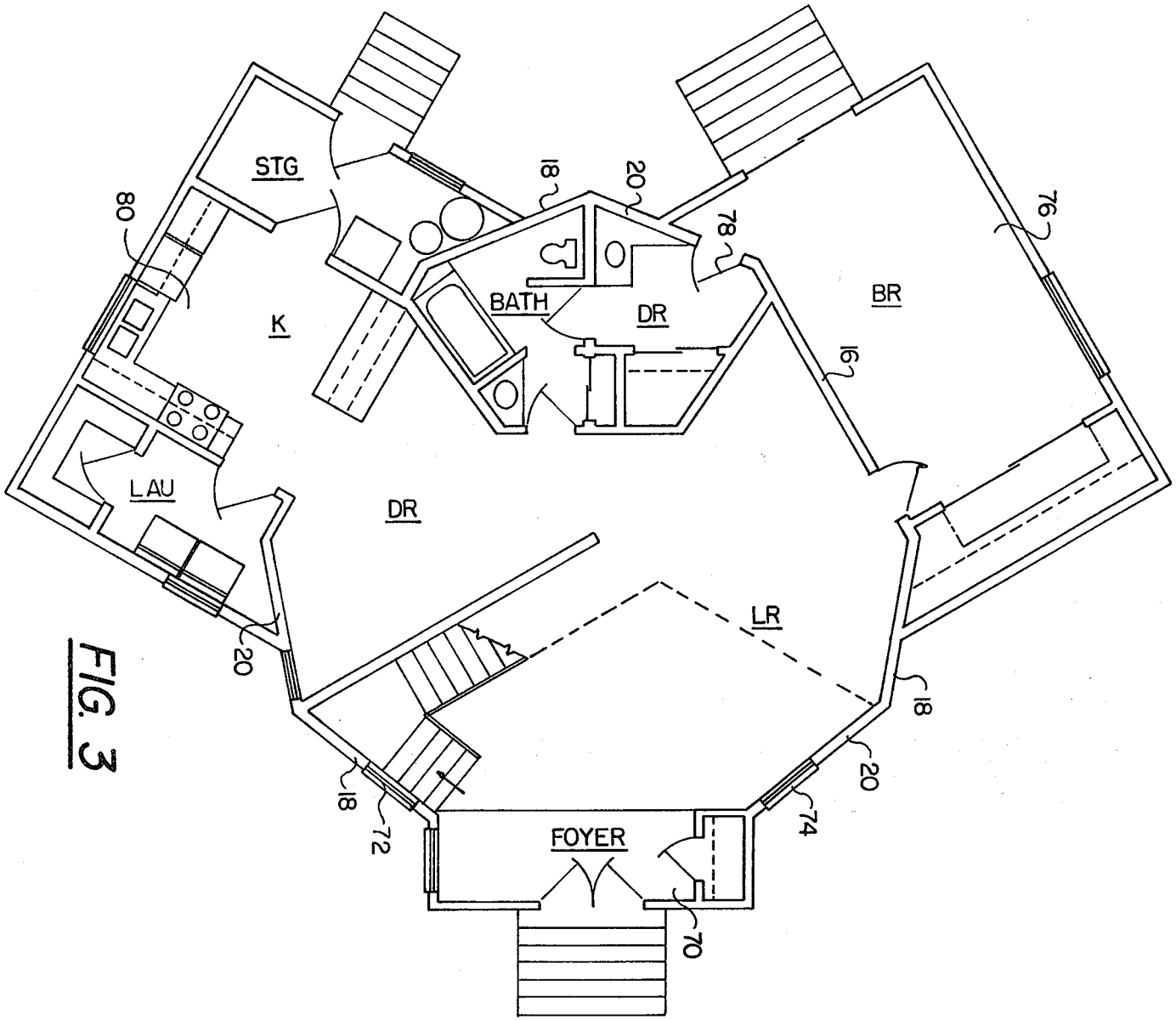
FIG. 3 is a top plan view of a floor plan for an alternate embodiment of the invention.

Turning now to FIG. 3, a basic floor plan shows a central basic central shell outline conforming to that of the shell of FIG. 1, shown in schematic with interior bathroom, living room and dining room layouts shown generally with bedroom and other rooms added on to certain sections of the central shell structure. The basic plan view of the central shell provides an irregular nonagon configuration. These add-ons have a generally conventional box-like configuration and no attempt is made to show the roof interface of these portions of the structure. It is apparent however that the vertical rectangular wall panels simplify the interface with these box-like room additions with the provision of door ways and the like greatly simplified. In the specific configuration the various add-ons are shown to be added on at the location of the various rectangular panels 16 of the overall shell structure.

With specific reference to FIG. 3, a foyer 70 is shown in schematic outline form having a generally rectangular floor plan configuration with the width thereof conforming substantially to the width of the rectangular panel where connection is made to the shell structure. The overall opening of the foyer could conform precisely to that of the rectangular panel with a corresponding ease of construction of the interface of the foyer with the shell structure. The height of the rectangular panel for the described embodiment would be on the order of about 9 feet, 9 inches in height with a width of about 15 feet, 1 and ⅞ inches. The quadrilateral panels to each side of the rectangular panels would have a similar height on the one side with the other side having a height of about 5 feet, 8 inches. This gives the height for the panels 18 and 20 for the installation of conventional windows 72 and 74 as schematically shown in FIG. 3.

A bedroom 76 having a generally rectangular floor plan by having a length exceeding that of the rectangular panel at the line of interface, joins at another rectangular panel portion of the shell structure. The walls however intersect and connect with quadrilateral side panels 18 and 20. The vertical walls of these side panels and the height thereof are such as to enable quick and easy connection in the interface therewith. Similarly, the panel permits the installation of conventional doors as shown at 78.

A kitchen with laundry and storage facilities at the sides thereof are shown at 80 and interface with the rectangular panel and the adjacent quadrilateral panels 18 and 20 as previously described. Thus, the construction provides for readily interfacing box-like conventional structure with the central housing shell.

Figure 4:
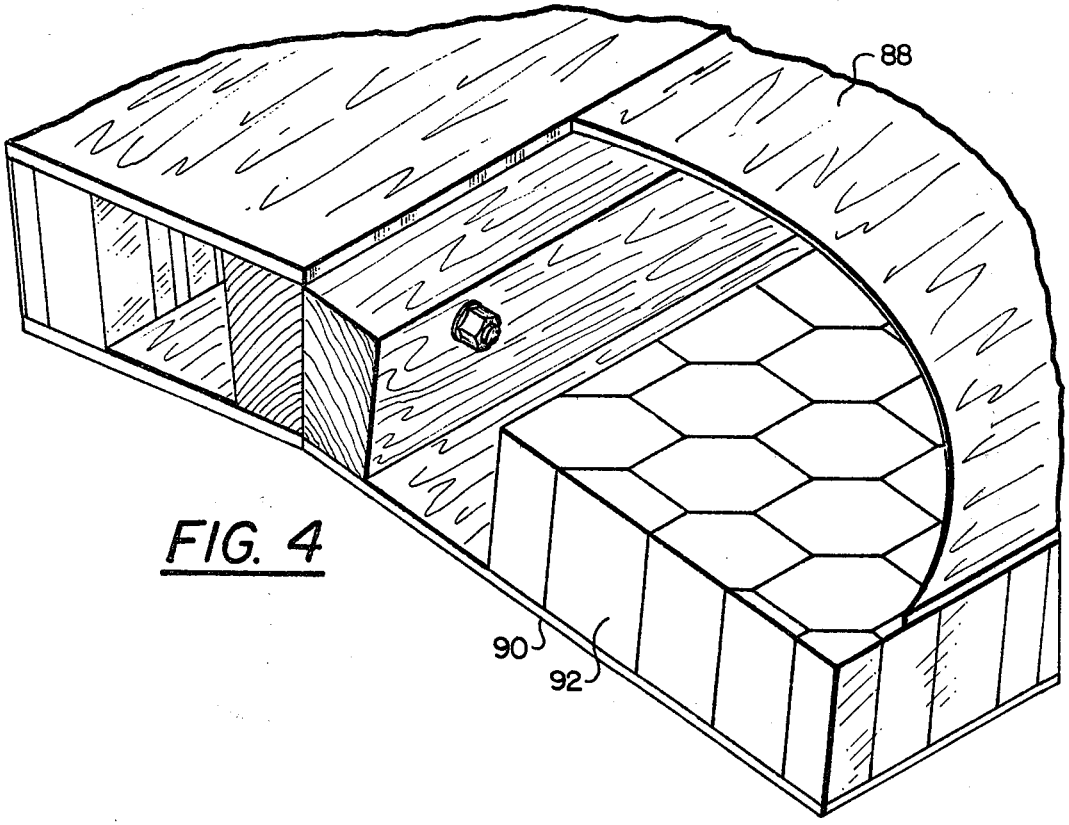
FIG. 4 is a perspective view of an enlarged detailed portion showing construction details.
Figure 5:
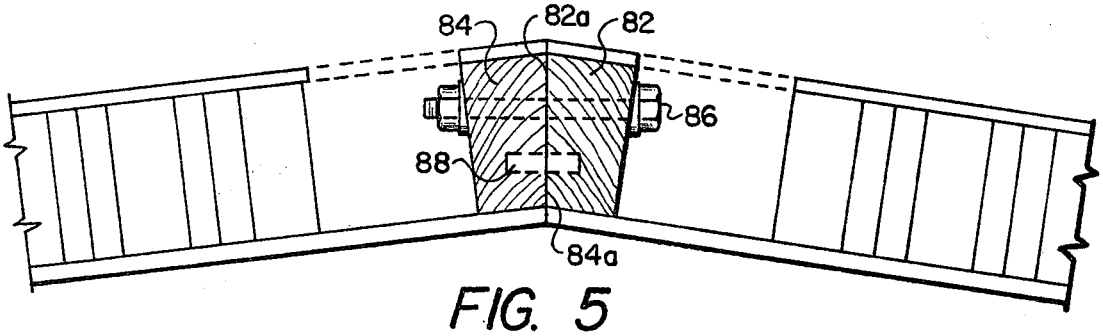
FIG. 5 is an end view of the joint of FIG. 4.

Turning to FIG. 4, certain details of the construction are illustrated wherein a section at the interface of a pair of triangular panels making up, for example, the pentagonal panel 12 is illustrated. This joint and the construction of the panels include a framework of bevelled frame members 82 and 84 on the order of approximately 2×4, however having bevelled or angled faces **82*a* and 84*a* which mate together and are secured either by a bolt and nut combination 86 and a dowel 88** or other means as will be described.

Each of the panels is made up of a frame of the frame members and covered by means of an outer panel 88 which may be for example ½ inch plywood or similar structure. An inner sheet 90 of a suitable wall board or the like, such as gypsum board or the like, is applied to the inside of the panel. Disposed between the inner and outer panels is an insulation structure 92 of honeycomb like structure which adds strength as well as insulating characteristics to the panel. A honeycomb structure formed of paper or the like material forming the walls of the honeycomb cells is available from Pacific Thermatron Industries, Inc. of San Diego, Calif. also manufactured by Kraft Paper Company.

Figure 6:
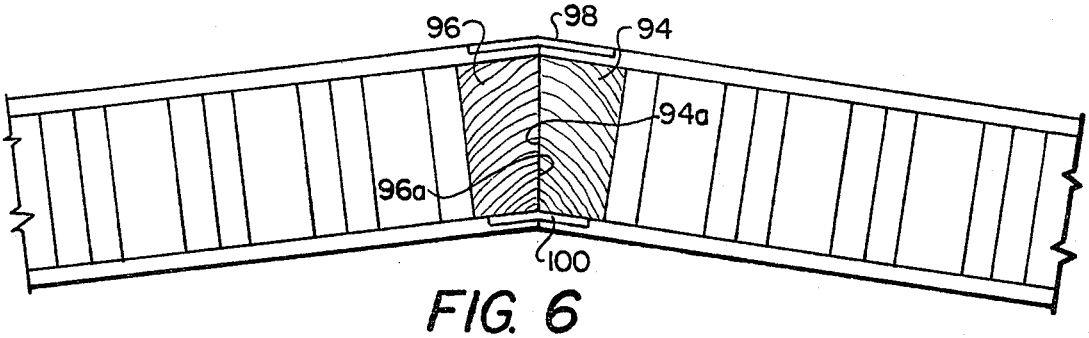
FIG. 6 is a view like FIG. 5 showing alternative joint structure.

An alternate technique for securing adjacent panels is shown in FIG. 6 wherein a pair of adjacent panels include facing frame members 94 and 96 with the faces thereof **94*a* and 96*a* bonded together by a suitable adhesive, such as wood or carpenters glue, or the like. In addition, and an alternative thereto, a plate 98 may be embedded in and recessed in the upper skin of the adjacent panels. Similarly, a plate 100 may be utilized to overlap the joint on the underside and secured such as by nails or the like directly into the frame members 94 and 96**.

The above described arrangement provides a rugged and high strength building structure having provision for readily accommodating box-like add-on configurations as well as conventional doors and window units.

While I have illustrated and described my invention by means for specific embodiments, it is to be understood that numerous changes and modifications may be made therein without departing from the spirit and scope of the invention as defined in the appended claims.

Having described my invention, I now claim:

1. A self supporting modular building shell structure comprising:

a peripheral vertical wall structure defined by rectangular panels separated by pairs of irregular guadrilateral panels, the base of said peripheral vertical wall defining an irregular nonagon;

a generally dome shaped roof defined by a single central equilateral hexagonal unit surrounded by alternate equilateral pentagonal and equilateral trapezoidal units support on said peripheral wall structure, wherein each trapezoid roof panel is supported on top of a rectangular wall panel, and said pentagonal roof units are each supported on a pair of quadrilateral units.

2. The building structure of claim 1, wherein said hexagon unit and said pentagon units are each made up of individual triangular panels.

3. The building structure of claim 2, wherein the panels are joined along edges that are at an angle greater than 90 degrees to the outer surface of the panel.

4. The building structure of claim 3, wherein said panels are secured together by means of flat metal plate strips recessed in the panels and overlapping the joint.

5. The building structure of claim 4, wherein said rectangular panels are three in number, each having a height of about nine feet.

6. The building structure of claim 5, including at least one box-like room addition secured to and extending outward from said building structure at one of said rectangular panels.

7. The building structure of claim 6, wherein said building has a height of about 20 feet and a width of about 30 feet.

* * * * *